United States Patent [19]

Von Hoene et al.

[11] 4,063,943

[45] Dec. 20, 1977

[54] ELECTROSTATOGRAPHIC IMAGING METHOD

[75] Inventors: Donald C. Von Hoene, Fairport; John M. Magde, Williamson, both of N.Y.

[73] Assignee: Xerox Corporation, Stamford, Conn.

[21] Appl. No.: 716,742

[22] Filed: Aug. 23, 1976

[51] Int. Cl.[2] ..... G03G 13/22; G03G 13/24

[52] U.S. Cl. ..... 96/1 R; 96/1 C; 355/3 R; 361/225

[58] Field of Search ..... 96/1 R, 1 C; 355/3 SC, 355/3 BE

[56] References Cited

U.S. PATENT DOCUMENTS

| | | | |
|---|---|---|---|
| 3,457,070 | 7/1969 | Watanabe et al. | 96/1.4 |
| 3,536,483 | 10/1970 | Watanabe et al. | 96/1 R |

*Primary Examiner*—Roland E. Martin, Jr.
*Attorney, Agent, or Firm*—James J. Ralabate; James P. O'Sullivan; Jerome L. Jeffers

[57] ABSTRACT

Disclosed is a method of forming a latent electrostatic image on a segment of an electrostatographic photosensitive device which comprises a grounded conductive substrate having a layer of photoconductive material on its surface which is in turn overcoated with an insulating organic resin. The method comprises:

a. applying an initial electrostatic charge of one polarity to the surface of the photosensitive device,
b. advancing the segment of the photosensitive device toward a corona emitting grid which is wider than the segment selected,
c. activating the grid when the trailing edge of the segment reaches the lead edge of the grid to thereby apply an electronic field of either alternating current or direct current of polarity opposite that of the polarity of the initial charge,
d. exposing the segment to imagewise activating radiation in the full frame flash exposure mode while continuing to apply the electronic field thereto;
e. continuing the advancement of the segment past the corona emitting grid while continuing the application of the electronic field thereto until the lead edge of the segment reaches the rear edge of the grid and then deactivating the grid; and
f. forming an imagewise potential distribution across the insulating layer by uniformly exposing the segment to activating radiation.

10 Claims, 8 Drawing Figures

ELECTROSTATOGRAPHIC IMAGING METHOD

BACKGROUND OF THE INVENTION

This invention relates to electrostatographic copying and more particularly to a novel method of imaging a particular type of electrostatographic photoreceptor. The art of xerography, as originally disclosed by C. F. Carlson in U.S. Pat. No. 2,297,691, involves the formation of an electrostatic latent image on the surface of a photosensitive plate normally referred to as a photoreceptor. The photoreceptor comprises a conductive substrate having on its surface a layer of a photoconductive insulating material. Normally, there is a thin barrier layer between the substrate and the photoconductive layer to prevent charge injection from the substrate into the photoconductive layer upon charging of the plate's surface.

In operation, the plate is charged in the dark, such as by exposing it to a cloud of corona ions, and imaged by exposing it to a light/shadow image to selectively discharge the photoreceptor and leave a latent image corresponding to the shadow areas. The latent electrostatic image is developed by contacting the plate's surface with an electroscopic marking material known as toner which will adhere to those portions of the plate which retain the electrostatic charge.

One type of electrostatographic photoreceptor comprises a conductive substrate having a layer of photoconductive material on its surface which is overcoated with a layer of an insulating organic resin. Various methods of imaging this type of photoreceptor are disclosed by Mark in his article appearing in *Photographic Science and Engineering,* Vol. 18, No. 3, May/June 1974. The processes referred to by Mark as the Katsuragawa and Canon processes can basically be divided into four steps. The first is to charge the insulating overcoating. This is normally accomplished by exposing it to d.c. corona of a polarity opposite to that of the majority charge carrier. When applying a positive charge to the surface of the insulating layer, as in the case where an n-type photoconductor is employed, a negative charge is induced in the conductive substrate, injected into the photoconductor and transported to and trapped at the insulating layer-photoconductive layer interface resulting in an initial potential being solely across the insulating layer. The charged plate is then exposed to a light and shadow pattern while simultaneously applying to its surface an electronic field of either alternating current (Canon) or direct current of polarity opposite that of the initial electrostatic charge (Katsuragawa). This step is carried out until the plate's surface potential is driven to zero (Canon) or to a chosen potential opposite in sign to that of the original surface potential (Katsuragawa). The plate is then uniformly exposed to activating radiation to produce a developable image with potential across the insulating overcoating and simultaneously reduce the potential across the photoconductive layer to zero.

The technique of applying an electronic field to the surface of the photosensitive device simultaneous with imagewise exposure is not particularly adaptable to imaging in the full frame flash exposure mode. This is the case because the flash exposure of a full frame is generally on the order of about 50 microseconds; a period which is too short for corotrons of ordinary efficiency to drive the surface potential to the selected level. It has more recently been discovered that good contrast potentials can be achieved on an insulator overcoated plate with imaging in the full frame flash exposure mode by shunting the photosensitive device to some preselected voltage both before and after the imaging step. This process is effective in that it provides good contrast potentials. However, it is difficult to provide equal shunting to all parts of the segment to be imaged both before and after imagewise exposure. Since lead to trail edge uniformity is desirable in a copying process, an improvement in the previously described process would be desirable. Accordingly, it is an object of the present invention to provide a novel method for the formation of an electrostatic latent image on an insulator overcoated electrostatographic photosensitive device.

A further object is to provide such a method which is suitable for use in conjunction with imaging in the full frame flesh exposure mode.

An additional object is to provide such a method which provides lead edge to trail edge uniformity in contrast potentials.

SUMMARY OF THE INVENTION

The present invention is a method of forming a latent electrostatic image on a segment of electrostatograhic photosensitive device. The photosensitive device comprises a grounded conductive substrate having on its surface and in injecting contact with a layer of photoconductive material which is in turn overcoated with a layer of an insulating organic resin. The method comprises the consecutive steps of:

a. applying an initial electrostatic charge of polarity opposite to that of the majority carrier of the photoconductive material to the surface of the photosensitive device to provide an initial potential which is solely across the insulating layer;

b. advancing the segment of the photosensitive device toward a corona emitting grid, which grid is in operative relationship with the photosensitive device and is wider than the segment of the photosensitive device on which the latent image is to be formed;

c. activating the grid when the trailing edge of the segment reaches the lead edge of the grid to thereby apply an electronic field of either alternating current or direct current of polarity opposite that of the polarity of the initial charge to drive the initial potential to a potential included in the range extending from a potential less than the initial potential through zero to a chosen potential opposite in sign to the polarity of the initial potential;

d. exposing the segment to imagewise activating radiation in the full frame flash exposure mode while continuing to apply the electronic field thereto to begin the formation of electrostatic contrast potentials stored across the insulating layer;

e. continuing the advancement of the segment past the corona emitting grid while continuing the application of the electronic field thereto until the lead edge of the segment reaches the rear edge of the grid and then deactivating the grid to complete the formation of the contrast potentials stored across the layer of photoconductive material in accordance with the lifetimes of photogenerated charge carriers and the ultimate potential to which the segment's surface is to be charged, such potential being included in the range extending from a potential less than the initial potential through zero to a chosen potential opposite in sign to the polarity of the initial potential; and f. making the imagewise potential distribution across the insulating layer available for development by uniformly exposing the segment to activating radiation or allowing the inherent dark decay of the photoconductor or both to remove all imagewise potential distribution in the photoconductive layer.

DETAILED DESCRIPTION AND PREFERRED EMBODIMENTS

Figure 1:
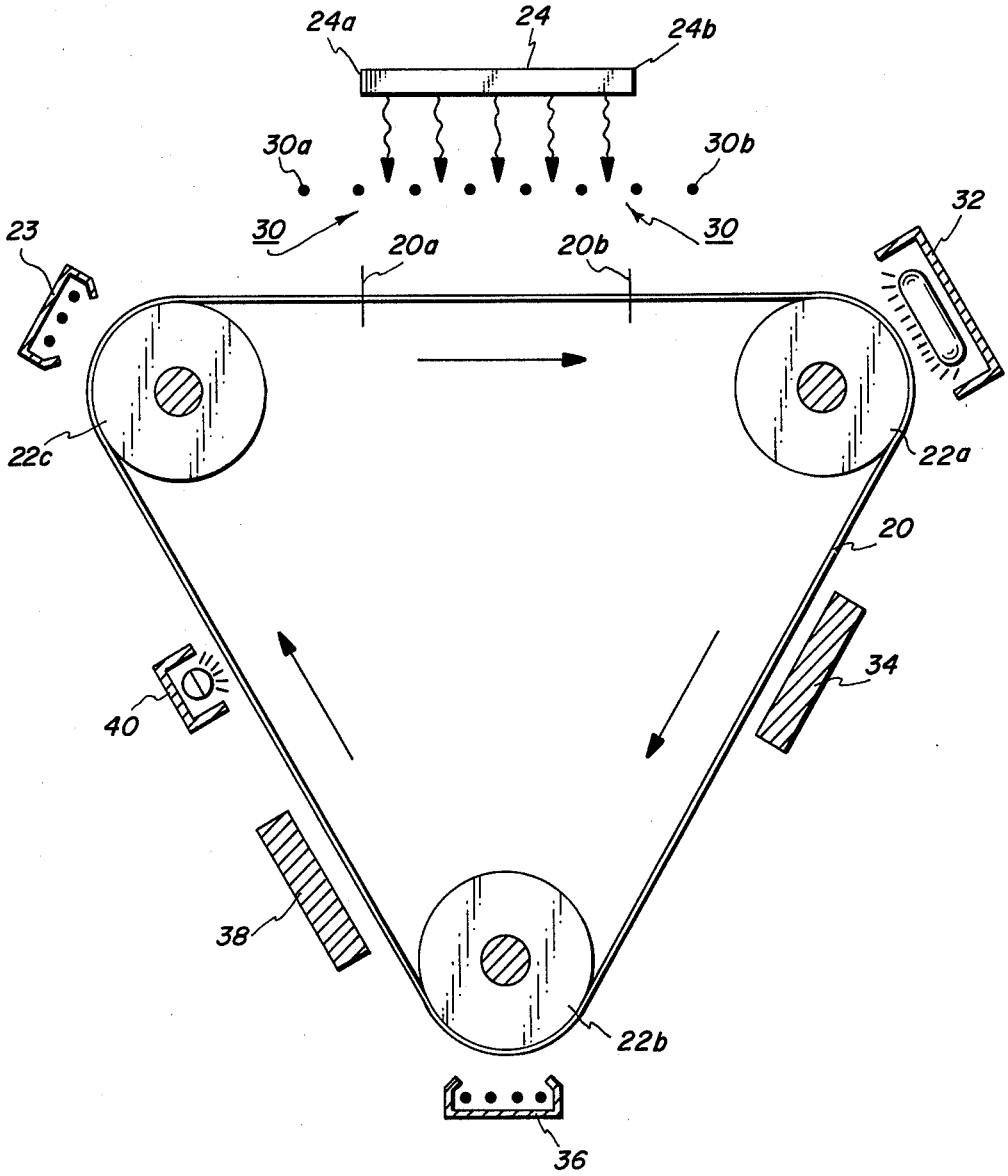

The method of practicing the invention is more fully illustrated by FIG. 1. In FIG. 1 the photosensitive device is depicted as an endless belt 20 mounted on a tri-roller setup, but it should be noted that this is only one of many configurations which can be employed. In operation, the belt rotates in a clockwise direction around the tri-rollers depicted as 22*a*, 22*b* and 22*c*. The photosensitive device is pre-sensitized as it passes under pre-exposure corotron 23. In this step, the segment is charged to the desired initial voltage ($V_o$) to provide an initial potential across the layer of insulating material. Flood illumination may be used at this point to eliminate the field in the photoconductor thereby placing the field solely across the insulating layer. A flash lamp 24 is mounted in proximity to the belt and operates in such a manner that a full frame of graphic material is flashed upon a selected segment of the device. The segment of the device to be imaged is depicted as that portion between points 20*a* and 20*b* of the belt. This segment is coextensive in length with the effective illumination width of the flash lamp. Between the flash lamp and the photosensitive device are positioned a grid of corotron wires generally depicted as 30 with the first of these wires being designated 30*a* and the last in the series being 30*b*. The corotron grid is synchronized with the movement of the photosensitive device so that the grid is activated when point 20*a* of the belt (the trailing edge of the segment) comes into alignment with point 30*a* (the lead edge of the grid). As point 20*a* moves from point 30*a* to the area under the exposure lamp, i.e. point 20*a* of the belt comes into alignment with the near edge of the flash lamp 24*a*, the segment to be imaged is pre-shunted to an arbitrary voltage, for example, V where $0 \leqq V \leqq V_o$ to establish a field $E_p$ in the photoconductor where $0 \leqq E \leqq E_p$ max. This requirement and rotation speed of the belt determines the distance between the first corotron wire 30*a* and the near edge of flash lamp 24*a*. When the segment to be imaged is under the flash lamp, i.e. points 20*a* and 20*b* of the belt are in alignment with points 24*a* and 24*b* of the flash lamp, the intelligence to be copied is flashed onto the segment. The distance between the rear edge of the flash lamp 24*b* and the last corotron wire of the grid 30*b* is likewise sufficient to complete shunting after exposure. The corotron grid is deactivated when the lead edge of the segment 20*b* comes into alignment with the last corotron wire of the grid 30*b*. This procedure for controlling the time the corotron grid is on and off causes every point on the segment to be provided with equivalent shunting time and therefore equal discharge to eliminate lead to trail edge variation because every point on the segment will have exactly the same history. By the time the corotron grid is deactivated, the creation of an imagewise contrast potential across the photoconductive layer is completed. The segment continues to move until it passes light housing 32 where it is uniformly exposed to activating radiation to reduce the voltage across the photoconductive layer to its residual voltage thereby yielding an imagewise potential distribution across the insulating layer. Alternatively, the inherent dark decay of certain photoconductors can be used in lieu of flood exposure.

At this point, the imagewise potential distribution (latent image) can be developed in the conventional manner which is accomplished at developer station 34. After development, the toner image is transferred to a receiving member at the transfer station (not shown) whereupon the imaged segment of the photoreceptor moves on to the pre-clean corotron 36 where it is subjected to an a.c. field or a field of polarity opposite to that provided by the charging corotron 23. The imaged segment then moves to cleaning station 38 where any residual toner from the development process is removed by conventional means. The last step in the cycle involves erasing any residual surface potential by exposing the photoreceptor uniformly to activating radiation and the output of an a.c. corotron or other device such as a contact discharging device at erasure station 40. After this step, the segment is ready to begin the next cycle by being charged at charging corotron 23.

Figure 2:
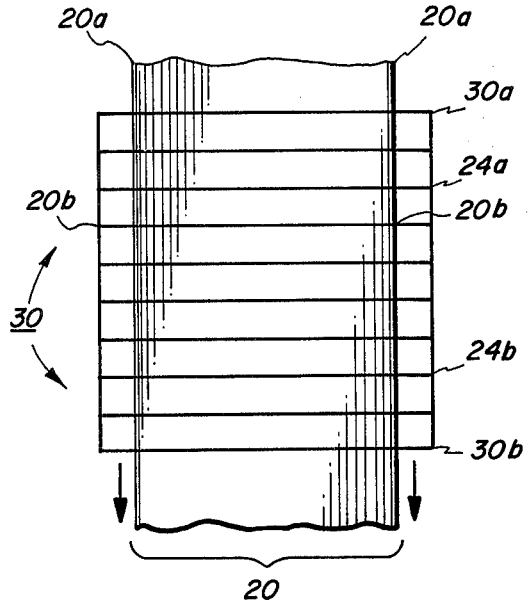
Figure 3:
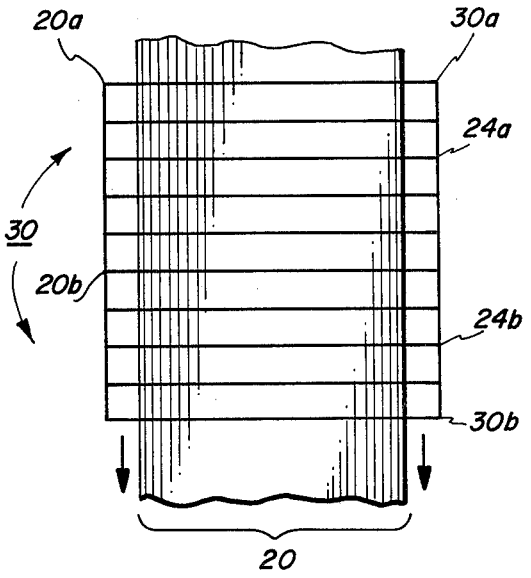
Figure 4:
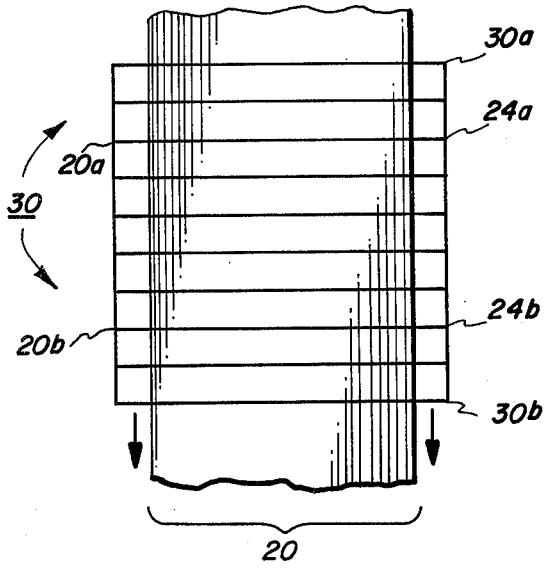
Figure 5:
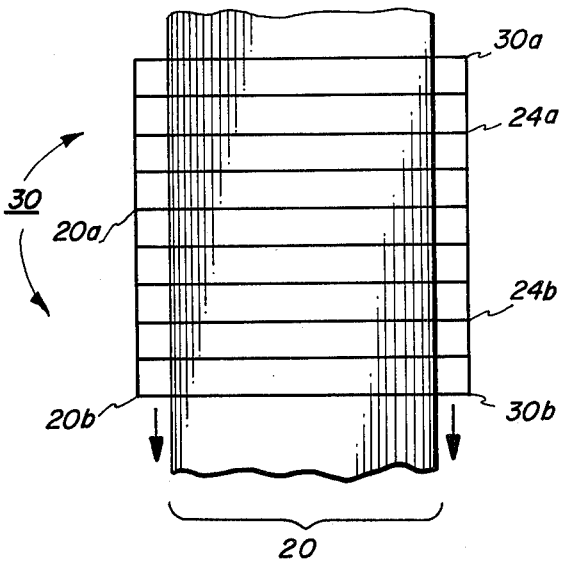

The operation of the invention is more fully disclosed in FIGS. 2 through 5 which represent top views of the photosensitive device looking downward through the grid. In FIG. 2, the segment of the photosensitive device to be imaged is depicted as that portion of the device 20 between planes 20*a* and 20*b*. This segment is only partially under the corona emitting grid and the corotron wires, therefore, are not activated. In FIG. 3, the segment is depicted as having advanced so that plane 20*a*, the trailing edge of the segment, is directly beneath corotron wire 30*a*, the lead edge of the corotron grid. At this point, the corotron is activated. In FIG. 4, the segment is depicted as having advanced to the exposure position. In this position, planes 20*a* and 20*b* of the segment are directly under the full frame exposure width of the flash lamp, that is plane 20*a* is directly under 24*a*, the lead edge of the flash lamp, and plane 20*b* is directly under 24*b*, the rear edge of the flash lamp. At this point in time, a light/shadow image is flashed on the segment in the typical full frame flash exposure mode. In FIG. 5 the segment has advanced to a point where the lead edge of the segment 20*b* has reached a position just under the rear edge of the corona emitting grid. At this point the grid is deactivated.

The method of the present invention can be used to form a latent image on any photosensitive device comprising a grounded conductive substrate having on its surface a layer of photoconductive material which is in turn overcoated with a layer of an insulating resin.

The conductive substrate upon which the layer of photoconductive material is deposited can be made of any suitable conductive material. It may be rigid as in the case where a flat plate or drum configuration is employed, but must, of course, be flexible for use in the endless belt configuration depicted in FIG. 1. In this regard, a continuous, flexible, nickel belt or a web or belt of an aluminized polymer such as Mylar can be conveniently used.

If the substrate is not naturally injecting, a suitable interface should be provided to cause injection of the majority carrier from the substrate into the layer of photoconducting material to cause the initial potential to reside solely across the overcoating. In the case of an ambipolar photoconductor, a suitable interface should be provided to block injection of the carrier of the sign of the initial surface potential.

The photoconductive material may be either n-type or p-type, organic or inorganic and is selected from those materials recognized in the art of xerography as being useful in photoreceptors. Exemplary of useful photoconductive materials are CdS, CdSe, $CdS_xSe_{1-x}$, ZnO, $TiO_2$ and selenium and selenium alloys such as Se/Te and Se/As. Typically, these materials are dispersed in an insulating resin as binder such as the configuration disclosed in U.S. Pat. No. 3,121,006 or the geometry controlled configuration disclosed by R. N. Jones in U.S. Pat. No. 3,787,208.

The insulating resin which constitutes the top layer of the photosensitive device can be any material which has high resistance against wear, high resistivity and the capability of binding electrostatic charge together with transparency or translucency to activating radiation. Examples of resins which may be used are polystyrene, butadiene polymers and copolymers, acrylic and methacrylic polymers, vinyl resins, alkyd resins, polycarbonate resins, polyethylene resins and polyester resins.

The method of practicing the invention is further illustrated by the following examples.

EXAMPLE I

Figure 6:
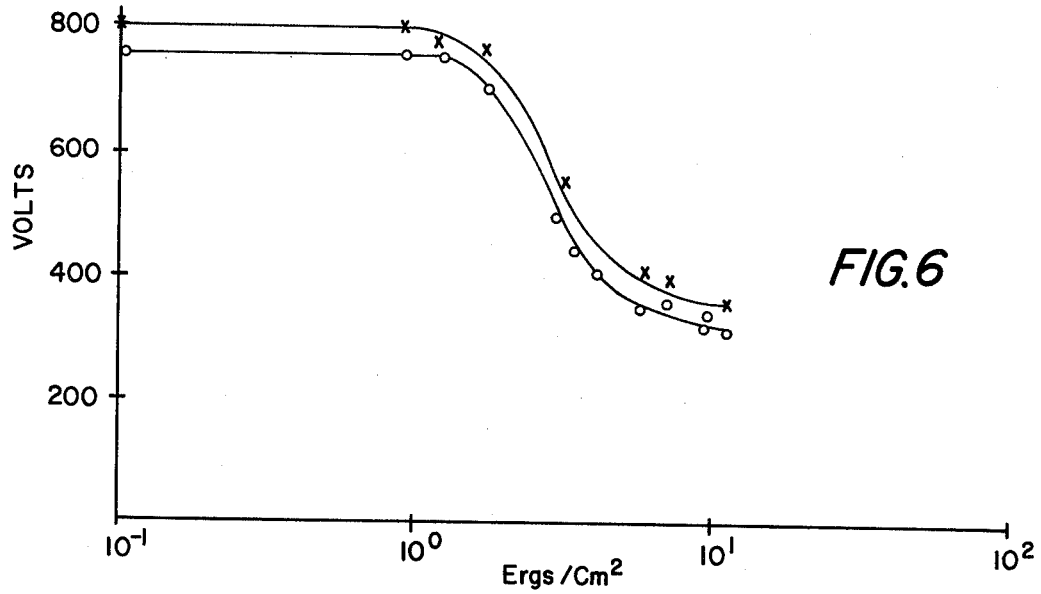
Figure 7:
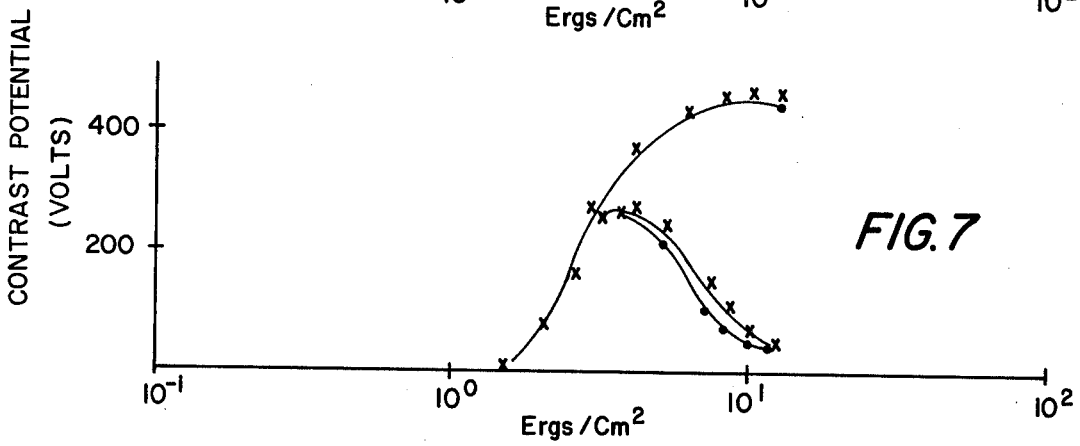

An electrostatographic photosensitive device is provided which comprises from the bottom up an $\approx 65\ \mu m$ thick Mylar substrate, a thin layer of carbon black as an injecting interface, a 42 $\mu m$ thick photoconducting layer and a 23 $\mu m$ layer of Mylar as the insulating overcoating. The photoconducting layer is made up of 30 volume percent $CdS_{0.35}Se_{0.65}$ dispersed in an insulating polyester copolymer material to form a photoconductive binder layer. The device is attached to a 30 inch diameter aluminum drum and put through the following cycle:

The device is charged to an initial potential of +2300 volts at the charging corotron. The drum is rotated to pass the charged segment of the photosensitive device under a corotron/flash configuration which consists of three corotron wires spaced ¾ inch apart with a flash lamp positioned above the middle wire. The area of photoreceptor exposed was ½ inch wide. As the device rotates past the corotron/flash station it is secondarily charged with an a.c. corotron both before, during and after exposure. The cycle is completed by flood illuminating the device and bringing it in operative relationship with the erasure corotron. Five electrostatic probes are used to monitor potential values throughout the cycle period. The resulting discharge curves and contrast potentials are shown in FIGS. 6 and 7. The photoinduced discharge tail and contrast values are principally the result of low carrier lifetimes in this photoconductive material. These contrast values are sufficient to generate acceptable prints with the appropriate development systems.

EXAMPLE II

The experiment of Example I is repeated using a photosensitive device made up of an aluminum substrate coated with a 35 $\mu m$ thick layer of 40 volume percent CdS doped with $10^3$ ppm chlorine dispersed in a polyester copolymer. This photoconductive layer is, in turn, overcoated with a 25 $\mu$ thick layer of Mylar polyester insulating resin. These layers are bonded together with a 1 to 2 $\mu$ thick layer of adhesive.

Figure 8:
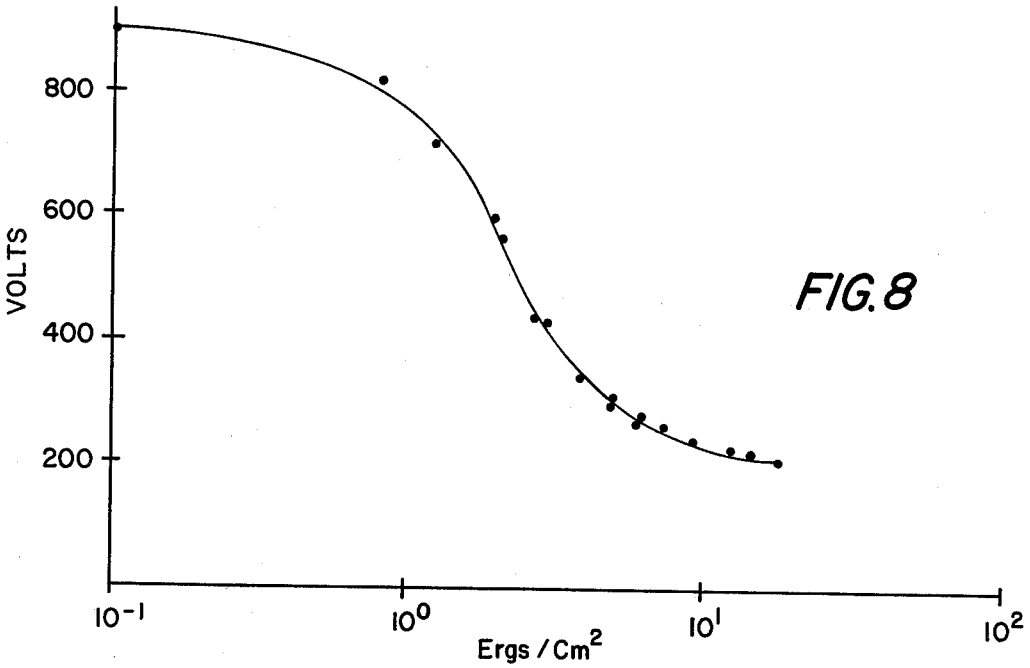

The results of this experiment are set out in FIG. 8. For a background exposure of 5 ergs/cm² the contrast values achievable for 0.3 and 1.0 densities are 170 and 540 volts, respectively. The lower discharge tail and higher contrast values are the result of the longer carrier lifetimes exhibited by this photoconductor.

What is claimed is:

1. A method of forming a latent electrostatic image on a segment of an electrostatographic photosensitive device comprising a grounded conductive substrate having on its surface and in injecting contact therewith a layer of photoconductive material which is in turn overcoated with a layer of an electrically insulating organic resin, which method comprises:

a. applying an initial electrostatic charge of polarity opposite to that of the majority carrier of the photoconductive material to the surface of the photosensitive device to provide an initial potential which is solely across the insulating layer;

b. advancing the segment of the photosensitive device toward a corona emitting grid which grid is in operative relationship with the photosensitive device and is wider than the segment of the photosensitive device on which the latent image is to be formed;

c. activating the grid when the trailing edge of the segment reaches the lead edge of the grid to thereby apply an electronic field of either alternating current or direct current of polarity opposite that of the polarity of the initial charge to drive the initial potential to a potential included in the range extending from a potential less than the initial potential through zero to a chosen potential opposite in sign to the polarity of the initial potential;

d. exposing the segment to imagewise activating radiation in the full frame flash exposure mode while continuing to apply the electronic field thereto to begin the formation of electrostatic contrast potentials stored across the insulating layer;

e. continuing the advancement of the segment past the corona emitting grid while continuing the application of the electronic field thereto until the lead edge of the segment reaches the rear edge of the grid and then deactivating the grid to complete the formation of the contrast potentials stored across the layer of photoconductive material in accordance with the lifetimes of photogenerated charge carriers and the ultimate potential to which the segment's surface is to be charged, such potential being included in the range extending from a potential less than the initial potential through zero to a chosen potential opposite in sign to the polarity of the initial potential; and f. making the electrostatic contrast potentials across the insulating layer available for development by uniformly exposing the segment to activating radiation or allowing the inherent dark decay of the photoconductor or both to remove all imagewise potential distribution in the photoconductive layer.

2. The method of claim 1 wherein the photoconductive material is n-type and the initial electrostatic charge is positive.

3. The method of claim 1 wherein the photoconductive material is p-type and the initial electrostatic charge is negative.

4. The method of claim 1 wherein the photosensitive device is in the form of an endless, flexible belt.

5. The method of claim 4 wherein the conductive substrate is nickel or an aluminized polymer.

6. The method of claim 1 wherein the substrate is not naturallly injecting and there is an interface between the substrate and photoconductive material to cause injection of the majority carrier from the substrate into the layer of photoconductive material.

7. The method of claim 1 wherein the photoconductive material is CdS, CdSe, $CdS_xSe_{1-x}$, ZnO, $TiO_2$, selenium or a selenium alloy.

8. The method of claim 1 wherein the photoconductive material is dispersed in an insulating resin as binder.

9. The method of claim 1 wherein the insulating material is polystyrene, a butadiene polymer or copolymer, an acrylic polymer, a methacrylic polymer, a vinyl resin, an alkyd resin, a polycarbonate resin, a polyethylene resin or a polyester resin.

10. The method of claim 9 wherein the polyester resin is poly(ethyleneterephthalate).

* * * * *